US007722917B2

(12) United States Patent
Shimomura et al.

(10) Patent No.: US 7,722,917 B2
(45) Date of Patent: May 25, 2010

(54) METHOD OF MANUFACTURING INK JET HEAD AND APPARATUS USING SEALANTS

(75) Inventors: Masako Shimomura, Kanagawa (JP); Tadayoshi Inamoto, Tokyo (JP); Kazunari Ishizuka, Shizuoka (JP); Ryoichiro Kurobe, Kanagawa (JP); Yohei Sato, Kanagawa (JP); Akihiko Shimomura, Kanagawa (JP); Isao Imamura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 311 days.

(21) Appl. No.: 10/957,686

(22) Filed: Oct. 5, 2004

(65) Prior Publication Data

US 2005/0078143 A1 Apr. 14, 2005

(30) Foreign Application Priority Data

Oct. 9, 2003 (JP) ..... 2003-350904
Sep. 7, 2004 (JP) ..... 2004-259628

(51) Int. Cl.
*B05D 5/12* (2006.01)
*B05D 3/02* (2006.01)

(52) U.S. Cl. ..... 427/58; 427/284; 427/384

(58) Field of Classification Search ..... 427/58, 427/384, 402, 284

See application file for complete search history.

(56) References Cited

U.S. PATENT DOCUMENTS

| | | | | |
|---|---|---|---|---|
| 5,442,386 | A * | 8/1995 | Childers et al. | 347/50 |
| 5,758,417 | A | 6/1998 | Kobayashi et al. | |
| 5,763,141 | A | 6/1998 | Shimomura et al. | |
| 6,241,340 | B1 * | 6/2001 | Watanabe et al. | 347/50 |
| 6,335,750 | B2 * | 1/2002 | Horiuchi et al. | 347/200 |
| 6,471,901 | B1 * | 10/2002 | Kawamura et al. | 264/267 |
| 6,609,782 | B2 * | 8/2003 | Mori | 347/50 |
| 6,790,309 | B2 * | 9/2004 | Miyagawa et al. | 156/272.2 |
| 2002/0003556 | A1 | 1/2002 | Mori | |

FOREIGN PATENT DOCUMENTS

JP 2002-19120 1/2002

* cited by examiner

*Primary Examiner*—Brian K Talbot
(74) *Attorney, Agent, or Firm*—Fitzpatrick, Cella, Harper & Scinto

(57) ABSTRACT

An ink jet head has a head substrate including discharge elements for discharging ink, with an electric wiring board being electrically connected to the head substrate, in which the periphery of the head substrate is sealed with a first sealant, and an electric splice between the head substrate and the electric wiring board is sealed with a second sealant. The first and second sealants contain the same base resin and curing agent, and the second sealant shows higher hardness than the first sealant after curing. This ink jet head is free from problems such as cavities and fissures at the boundary of the two sealants caused by a difference in linear expansion coefficients.

4 Claims, 7 Drawing Sheets

METHOD OF MANUFACTURING INK JET HEAD AND APPARATUS USING SEALANTS

This application claims priority from Japanese Patent Applications Nos. 2003-350904 filed Oct. 9, 2003, and 2004-259628 filed Sep. 7, 2004, which are hereby incorporated by reference herein.

BACKGROUND OF THE INVENTION

1. Field of the Invention

The present invention relates to an ink jet head and an ink jet printing apparatus having the head.

2. Description of the Related Art

According to a recording system using an ink jet head, heat energy or vibration energy is applied to ink to discharge the ink as fine droplets from nozzles to thereby form an image on a recording medium. An example of a method for manufacturing an ink jet head can be found in Japanese Patent Application Laid-open No. 2002-19120.

According to such a manufacturing method, an ink jet head is manufactured in the following manner. Initially, heat elements (discharge element part) and a wiring conductor for supplying electric power to the heat elements are formed on a silicon substrate, a protective film is formed on the wiring conductor, and ink passages and ink discharge ports are patterned using a resist.

Next, a material for nozzles is applied and cured, and holes for supplying the ink are opened in the silicon substrate from its backside to the discharge element part. The resist is then removed through the holes to thereby form the ink passages and discharge ports.

The silicon substrate is then cut into chips, each having a necessary size as a head, to yield head substrates. The head substrate is attached to a support plate made typically of alumina, and a plated layer or ball bump is formed on a pad for bonding a flexible wiring board. The flexible wiring board serves to supply electric power from outside of the head to the heat elements and other components. The flexible wiring board is then bonded to the resulting recording head.

Next, a sealant for sealing the periphery of the head substrate (chip) (hereinafter referred to as "chip-periphery sealant") is applied to thereby protect the side of the head substrate from ink and dust. After curing the chip-periphery sealant, an inner lead bonding (ILB) sealant for sealing an electric splice (hereinafter referred to as "ILB sealant") is then applied over the chip-periphery sealant.

The chip-periphery sealant for sealing the head substrate (chip) and the ILB sealant for sealing the electric splice must satisfy the following requirements.

The chip-periphery sealant must continuously flow, in a short time, in a narrow groove around the chip, having a width less than 1 mm, positioned at the boundary between the head substrate and the support plate supporting the head substrate. The chip-periphery sealant must also protect the chip (head substrate) from ink and other matter. The ILB sealant must completely seal the electric parts and must not peel off even when rubbed by a blade or wiper and even when paper jams and comes into contact with the sealed portion. The blade or wiper is placed in the printing apparatus and serves to clean the plane of the ink discharge ports on the top side of the head substrate. In addition, the ILB sealant must not contain components that adversely affect the ink-repellent function of the head face which is treated with, for example, an alkyl fluoride compound or low-molecular weight cyclic siloxane.

To satisfy the above-mentioned requirements, the chip-periphery sealant should preferably have low thixotropy, exhibit good flowability and be flexible over a wide range of temperatures. In contrast, the ILB sealant should preferably have high hardness, viscosity and thixotropy and maintain its shape.

In conventional techniques, an optimum material satisfying the requirements of the chip-periphery sealant, and one satisfying the requirements of the ILB sealant have been separately selected.

For example, a material comprising a flexible polybutadiene-modified epoxy resin and an amine curing agent is used for the chip-periphery sealant, and a "dam agent" ("dam material") comprising a bisphenol-A epoxy resin, a curing agent and about 70% of an acid anhydride and filler is used for the ILB sealant.

However, these conventional techniques are susceptible to further improvement.

For example, if the ILB sealant is applied and cured after the chip-periphery sealant is applied and cured, it takes a long time to cure these two sealants, dedicated thermostats must be provided for curing the chip-periphery sealant and the ILB sealant, respectively, and spaces for the two thermostats are required, thus inviting higher cost of manufacture. An attempt has been made to shorten the curing time by applying a chip-periphery sealant, subsequently applying an ILB sealant, and performing curing treatment of these sealants in a certain period. However, the following problems have arisen.

In some cases, a thin uncured layer is formed at the boundary between the chip-periphery sealant and the ILB sealant, and the ink penetrates the uncured layer to thereby cause electrical failures. In addition, the ILB sealant contains a larger amount of filler, has a higher specific gravity and thereby sinks into the flexible chip-periphery sealant. Thus, the chip-periphery sealant flows over the chip, or cavities are formed in the cured sealants and ink penetrates the cavities.

SUMMARY OF THE INVENTION

It is an object of the present invention to provide an ink jet head and an ink jet printing apparatus that do not have unreacted portions at the boundary between a sealant for protecting a head substrate (chip-periphery sealant) and a sealant for sealing an electric splice (ILB sealant).

Another object of the present invention is to provide an ink jet head and an ink jet printing apparatus that show good adhesion at the boundary between a sealant for protecting a head substrate (chip-periphery sealant) and a sealant for sealing an electric splice (ILB sealant).

Accordingly, the present invention provides, in one aspect, an ink jet head having a head substrate including discharge elements for discharging ink, and an electric wiring board being electrically connected to the head substrate, in which a periphery of the head substrate is sealed with a first sealant, an electric splice between the head substrate and the electric wiring board is sealed with a second sealant, the first and second sealants contain the same base resin and the same curing agent, and, after curing, the second sealant exhibits higher hardness than the first sealant.

The present invention further provides, in another aspect, an ink jet printing apparatus including the ink jet head, a carriage for bearing the ink jet head, and an electric connector that works to electrically connect the head substrate and the electric wiring board when the ink jet head is mounted to the carriage.

In addition and advantageously, the present invention provides a method for manufacturing an ink jet head having a head substrate containing discharge elements for discharging ink, and an electric wiring board being electrically connected to the head substrate, the method including the steps of applying a first sealant to the periphery of the head substrate, the periphery constituting the boundary between the head substrate and a member supporting the head substrate; applying a second sealant to an electric splice between the head substrate and the electric wiring board so as to cover the first sealant, the second sealant containing the same base resin and the same curing agent as the first sealant but having a higher hardness than the first sealant; and heating and thereby curing the first and second sealants simultaneously to thereby seal the boundary of the head substrate and the electric splice.

Further objects, features and advantages of the present invention will become apparent from the following description of the preferred embodiments with reference to the attached drawings.

DESCRIPTION OF THE PREFERRED EMBODIMENTS

Figure 1:
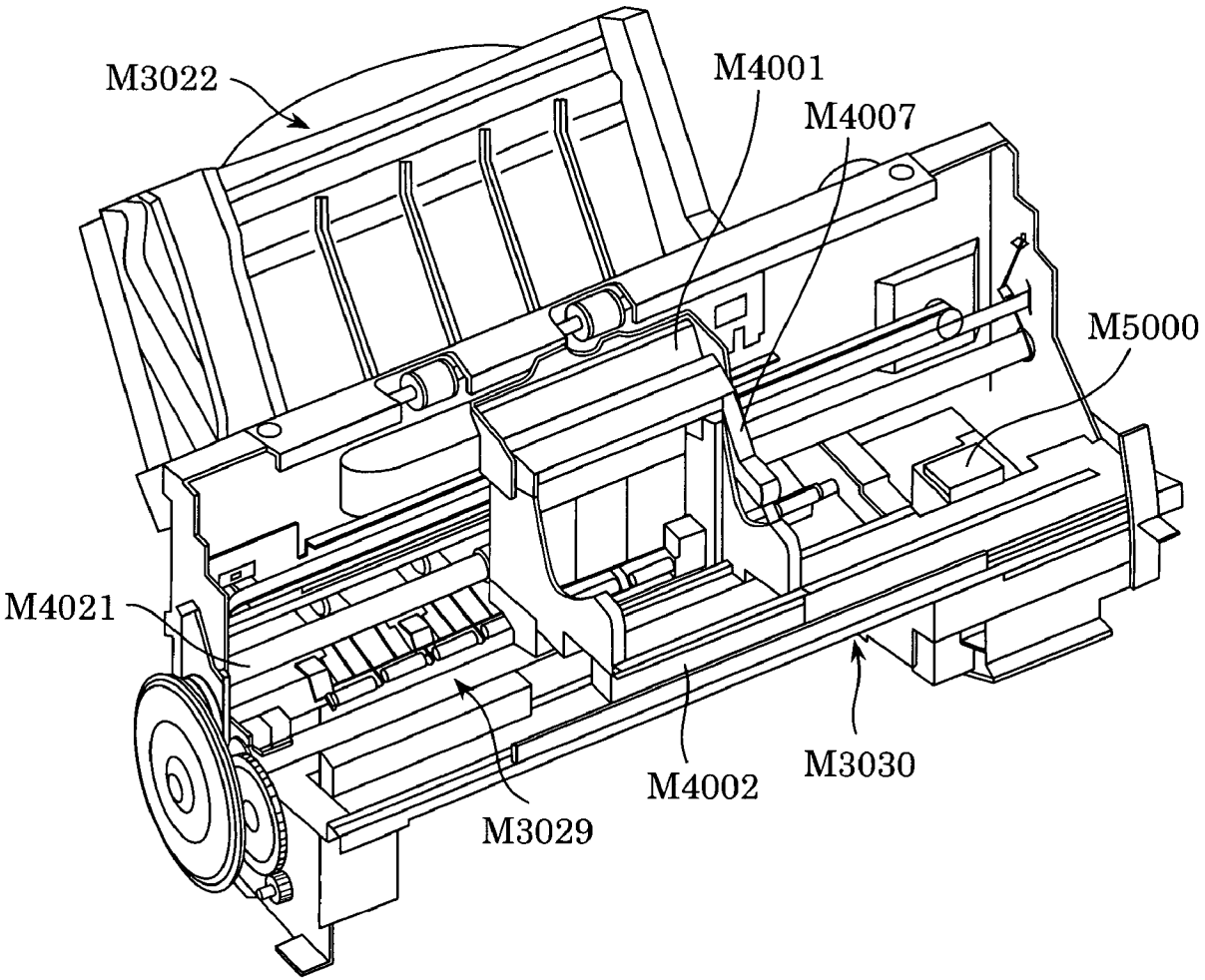
FIG. 1 is a perspective view of an ink jet printer in which the ink jet head of the present invention can be installed, in which an external member is removed.

The present invention has been achieved based on the following findings reached after intensive investigations to reveal the chemical mechanisms underlying the above-mentioned problems in the prior art.

(1) The bisphenol-A type epoxy resin begins to cure prior to the polybutadiene-modified epoxy resin and consumes the curing agent in the chip-periphery sealant at the boundary to thereby prevent the polybutadiene-modified epoxy resin from curing. Thus, an uncured layer is formed, into which ink penetrates to invite electrical failures.

(2) The solvent and hydrolysates such as lower alcohol and acid derived from the sealants are gasified to form cavities in the cured article, thus deteriorating the tight adhesion between the ILB sealant and the chip-periphery sealant.

(3) If the chip-periphery sealant and the ILB sealant comprise different base resins, they have different linear expansion coefficients, and thus gaps or space often forms at the boundary due to stress generated by shrinkage upon curing.

The present invention, achieved based on these findings, provides an ink jet head in which a sealant for protecting a head substrate (chip-periphery sealant) and a sealant for sealing an electric splice (ILB sealant) comprise the same base resin and the same curing agent and are arranged as partially overlapping layers. According to the invention, the chip-periphery sealant and ILB sealant can be cured simultaneously without the formation of an uncured portion (curing inhibition) at the boundary between the two sealants. Thus, the manufacturing method for the ink jet head can be simplified so as to reduce the production cost. In addition, the two sealants can adhere to each other more satisfactorily and function to achieve an excellent seal, because the stress caused by the difference between the linear expansion coefficients is reduced.

The phrase "comprising the same base resin and the same curing agent" used herein means that the cured products of the materials in question have identical infrared absorption spectra. In that regard, materials in which denaturation occurs to such a degree that it is not shown in the infrared spectra are considered as identical.

The present invention will be concretely illustrated in detail below.

Examples of the base resin for use in the ILB sealant are bisphenol epoxy resins, bromine-containing epoxy resins, phenol and cresol epoxy resins, alicyclic epoxy resins, glycidyl ester resins, glycidylamine resins, heterocyclic epoxy resins; silicone-modified, polybutadiene-modified or urethane-modified derivatives of these resins; and derivatives of these resins having plural functional groups incorporated by the use typically of pentaerythritol, trimethylolpropane or glycerin.

Acrylic resins, styrenic resins and modified derivatives thereof may also be used. Among them, resins having intramolecular epoxy groups are typically preferred for their high chemical resistance.

The chip-periphery sealant (head substrate periphery sealant) may comprise any of the above base resins. However, a base resin having good flowability and a low viscosity is preferred, because the resulting sealant is supposed to flow in a narrow gap between the chips and to mitigate stress. The head is stored at varying temperatures, which induces stress, due to the difference between the linear expansion coefficients of the sealant and the chip.

Of such compounds, epoxy resins having a polybutadiene skeleton, or a silicone skeleton, or both are preferred, of which those having a larger epoxy equivalent are more preferred. In particular, epoxy resins having an epoxy equivalent of 1000 or more are typically preferred. If the epoxy equivalent is less than 1000, the cured article may become excessively hard. Thus, the cured article or the chip breaks at low temperatures. The epoxy equivalent used herein is a value determined according to the method described in Japanese Industrial Standards (JIS) K7232-1986.

Preferred examples of the curing agent are amine curing agents including aliphatic amines such as ethylenediamine (EDA), diethylenetriamine (DETA), triethylenetetramine (TETA), tetraethylenepentamine (TEPA), dipropylenediamine (DPDA), diethylaminopropylamine (DEAPA) and hexamethylenediamine (HMDA), cyclic amines such as menthenediamine (MDA), isophoronediamine (IPDA), bis(4-amino-3-methyldicyclohexyl)methane, diaminodicyclohexylmethane, bis(aminomethyl)cyclohexane, N-aminoethylpiperazine and 3,9-bis(3-aminopropyl-2,4,8,10-tetraoxaspiro[5.5]undecane, aliphatic-aromatic amines such as m-xylenediamine, aromatic amines such as m-phenylenediamine (MPDA), diaminodiphenylmethane (DDM), diaminodiphenyl sulfone (DDS) and diaminodiethyldiphenylmethane, as well as polyaminoamides; acid and acid anhydride curing agents including aliphatic acid anhydrides such as dodecenyl succinic anhydride (DDSA), poly(adipic anhydride) (PADA), poly(azelaic anhydride) (PAPA), poly(sebacic anhydride) (PSPA), poly(ethyloctadecanedioic anhydride) (SB-20AH) and poly(phenylhexadecanedioic anhydride) (ST-2PAH), alicyclic acid anhydrides such as methyltetrahydrophthalic anhydride (Me-THPA), methylhexahydrophthalic anhydride (Me-HHPA), methylhimic anhydride (MHAC), hexahydrophthalic anhydride (HHPA), tetrahydrophthalic anhydride (THPA), trialkyltetrahydrophthalic anhydride (TATHPA) and methylcyclohexenecarboxylic acid (MCTC), aromatic anhydrides such as phthalic anhydride (PA), trimellitic anhydride (TMA), pyromellitic anhydride (PMDA), benzophenonetetracarboxylic anhydride (BTDA) and ethylene glycol bistrimellitate (TMEG), and halogen-containing acid anhydrides such as HET anhydride (chlorendic anhydride) and tetrabromophthalic anhydride (TBPA); as well as resole-type phenolic resins having hydroxyl groups of epoxy resins as crosslinking points, urea resins, melamine resins, isocyanates and block isocyanates. Any other substances that are used as curing agents for epoxy resins can also be used.

In addition, an amine-adduct or epoxy-adduct material can be used. Such a material comprises a curing agent covered with a resin of the same type as the base resin or the base resin covered with the curing agent, in which the covering resin melts by the action of heat upon curing to thereby initiate curing of the base resin with the curing agent.

The ILB sealant and the chip-periphery sealant preferably comprise the same curing agent. Thus, even if the curing agent of the ILB sealant and the curing agent of the chip-periphery sealant are mixed at the boundary, the base resin of the chip-periphery sealant can be cured satisfactorily.

The ILB sealant preferably further comprises a filler for achieving the desired hardness, thixotropy and dimensional stability.

Examples of the filler are silica, carbon black, titanium oxide, kaolin, clay and calcium carbonate, but any other filler can be used. The filler can have any form such as a pulverized form, crushed form or spherical form prepared by solution polymerization.

The content of the filler (the ratio of the weight of filler to that of the resulting sealant) may be set depending on the type and dimensions of the filler but is preferably 50% or more. More preferably, the filler is contained in the sealant in such a content that the resulting sealant has a thixotropic factor of 1.7 or more. However, the key factor is hardness at a specific level or higher, and the filler may not necessarily be used where the sealant can have a sufficient hardness without using the filler.

If the ILB sealant has a thixotropic factor below a specific level, it may not maintain its own shape. Thus, the applied ILB sealant flows, spreads and fails to cover the electric splice completely. Accordingly, the ILB sealant preferably has a thixotropic factor of 1.7 or more.

The ILB sealant must be hard also in order to prevent breakage or tearing due to, for example, strong friction force caused by paper jamming.

As is shown in the examples mentioned later, the ILB sealant should preferably have a Shore A hardness of 65 or more after curing. It should more preferably have a thixotropic factor of 1.7 or more when determined at 23° C. and a number of revolutions of 2 rpm and 20 rpm.

The chip-periphery sealant preferably has good flowability for improving the tact in production and generally does not comprise a filler. However, it may comprise a necessary amount of the filler to control its physical properties such as viscosity.

The chip-periphery sealant and ILB sealant may further comprise additives to improve their properties. Examples of such additives are silane coupling agents to increase adhesion to inorganic substances such as the heater board or the silicon wafer; defoaming agents for improving defoaming properties; and reactive monomers for controlling viscosity and/or reactivity.

In addition, amines, reactive monomers and catalysts may be used for accelerating the curing.

Certain ink jet printers with ink jet recording heads will be illustrated in detail as embodiments of the present invention with reference to FIGS. 1 to 7.

Printing Operation Mechanism

FIG. 1 is a schematic diagram of a serial ink jet printer from which an external member is removed. Specifically, the printing operation mechanism housed and held in a printer body comprises: an automatic feed unit M3022 to automatically feed a print medium into the printer body; a transport unit M3029 to guide the print media, fed one at a time from the automatic feed unit, to a predetermined print position and to guide the print medium from the print position to a discharge unit M3030; a print unit to perform a desired printing on the print medium carried to the print position; and a recovery unit M5000 to recover the ink discharge performance of the print unit.

The print unit comprises a carriage M4001 movably supported on a carriage shaft M4021 and a head cartridge H1000 (see FIG. 2) removably mounted on the carriage M4001.

Print Head Cartridge H1000

Figure 2:
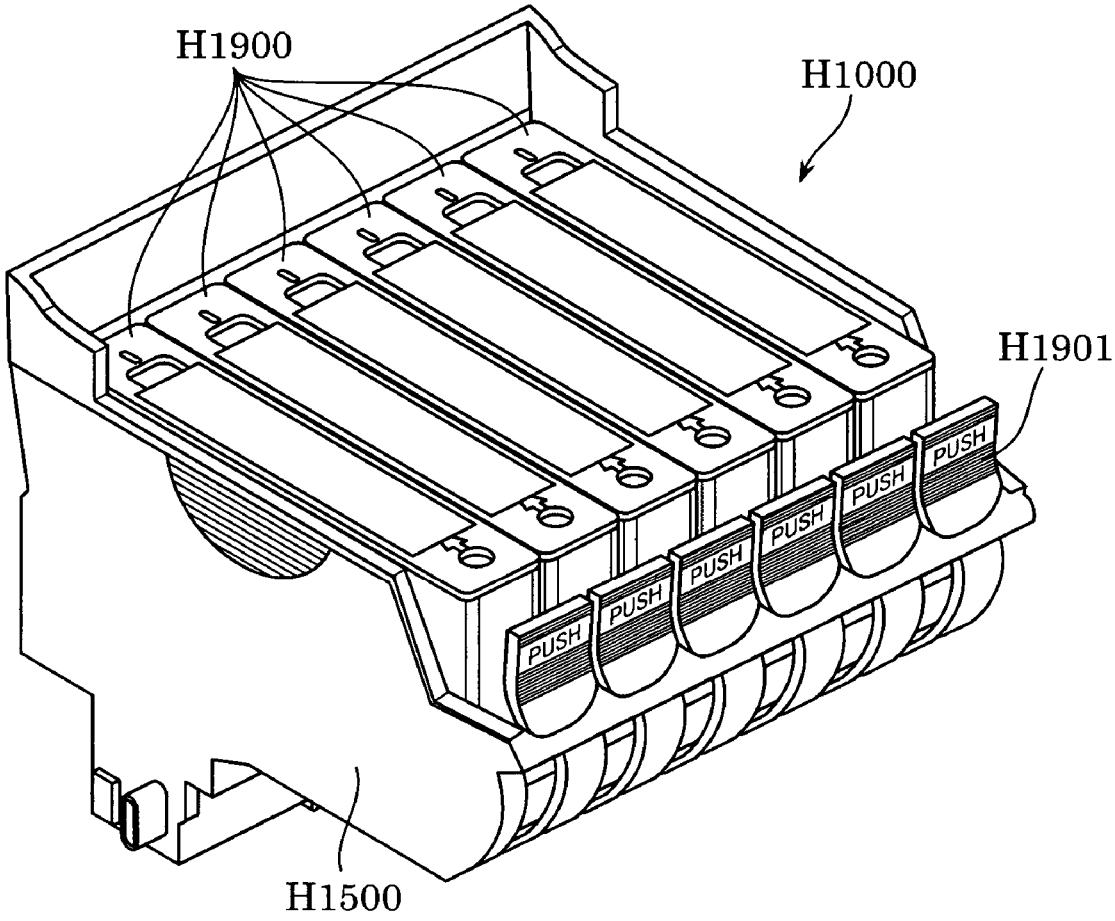
FIG. 2 is a perspective view of a head cartridge comprising the ink jet head of the present invention and ink tanks incorporated in the ink jet head.

First, the head cartridge H1000 constituting part of the print unit will be described with reference to FIGS. 2 and 3. The head cartridge H1000 in this embodiment has a tank holder H1500 for holding ink tanks H1900 containing inks, and a print head H1001 for discharging ink supplied from the ink tanks H1900 through discharge ports 16 according to print information. The head cartridge H1000 is of a "cartridge system" in which it is removably mounted to the carriage M4001 described later.

The ink tank for this head cartridge H1000 includes separate ink tanks H1900 of, for example, black, light cyan, light magenta, cyan, magenta and yellow to enable color printing with as high an image quality as that of a photograph. These individual ink tanks H1900 are removably mounted to the tank holder H1500 of the head cartridge H1000 by the operation of levers H1901, respectively. The levers H1901 are capable of elastically deforming for mounting ink tanks H1900 in the head cartridge H1000 and removing ink tanks H1900 from the head cartridge H1000.

Figure 3:
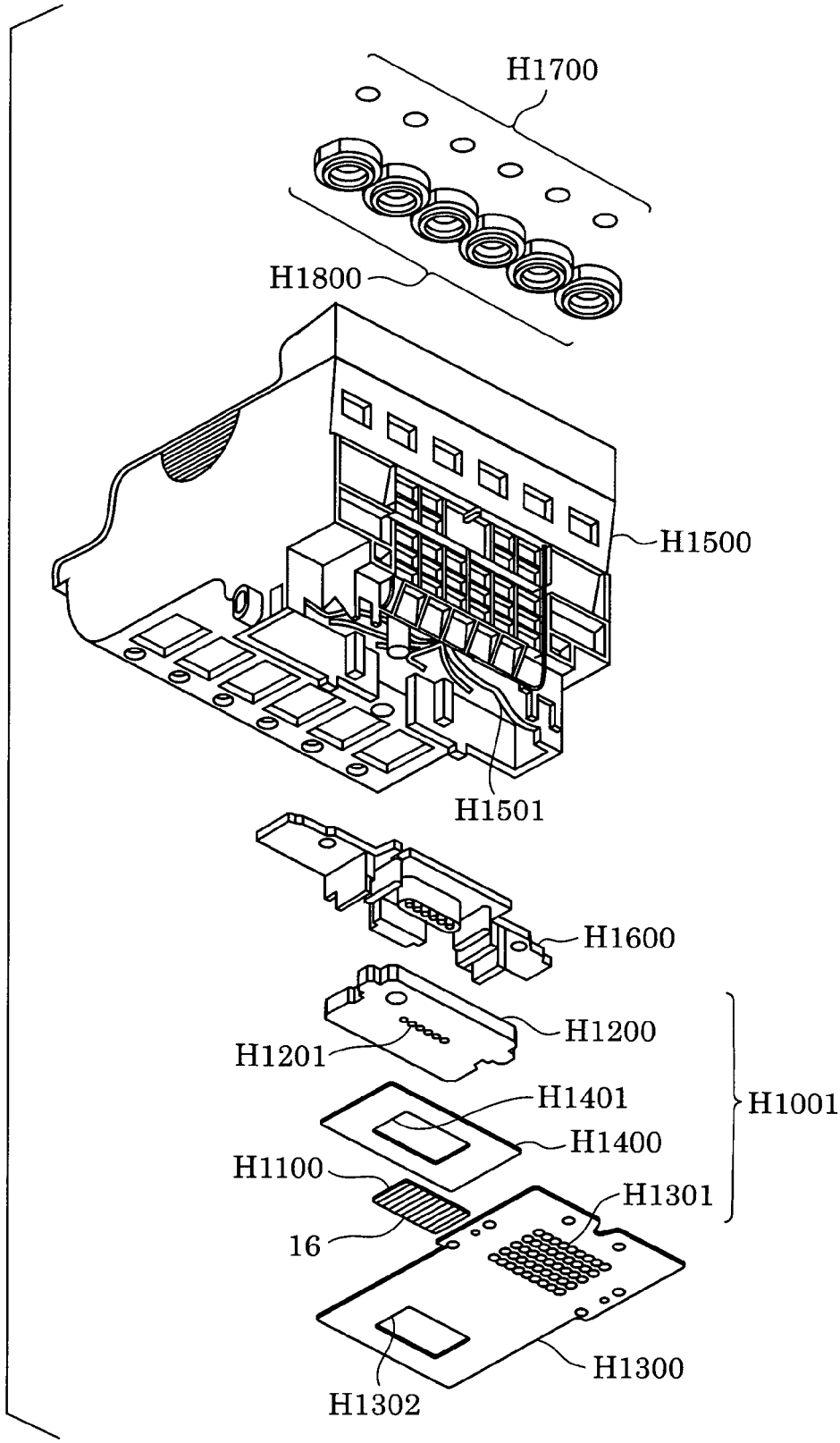
FIG. 3 is an exploded perspective view of the head cartridge of FIG. 2 when viewed from below.
Figure 4:
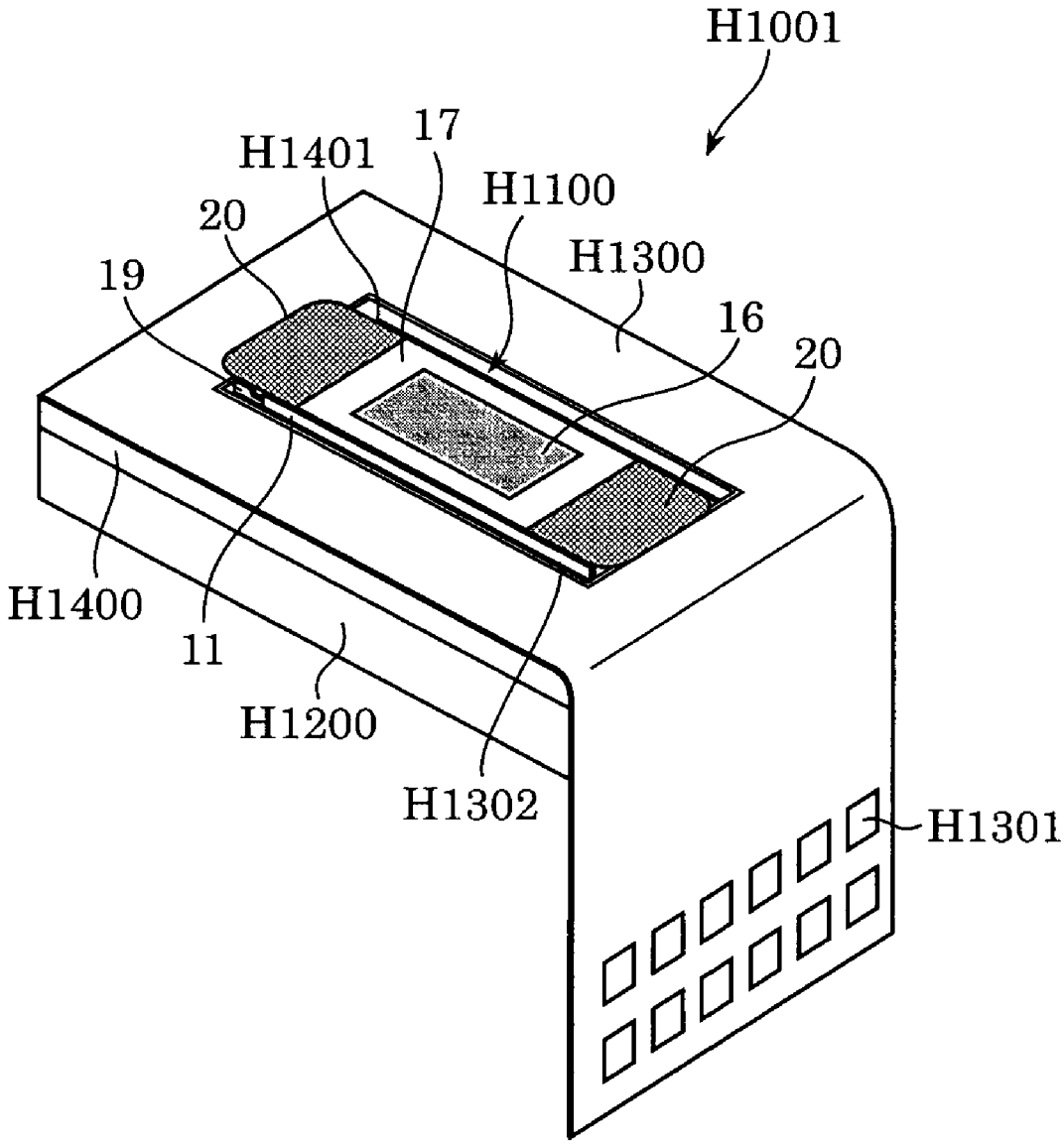
FIG. 4 is an enlarged perspective view of important parts of an ink jet head to which the present invention can be applied.

With reference to the exploded perspective view of FIG. 3, the print head H1001 comprises, for example, a head substrate H1100, a base plate H1200, an electric wiring board H1300 and a support plate H1400. The tank holder H1500 comprises, for example, a passage forming member H1600, filters H1700 and seal rubbers H1800.

The head substrate H1100 comprises a silicon substrate and, on one of its surfaces, formed by a film forming technique, a plurality of electrothermal energy converters 13 (see FIG. 4) to produce energy for discharging ink and electric wires made typically of aluminum for supplying electricity to individual electrothermal energy converters. A plurality of ink passages and a plurality of discharge ports 16, both corresponding to the electrothermal energy converters, are also formed by photolithography. Ink supply ports 12 (see FIG. 5 or 7) for supplying ink to the plurality of ink passages are arranged in the back of the head substrate H1100. The head substrate H1100 is securely bonded to the base plate H1200 which has ink supply passages H1201 for supplying ink to the head substrate H1100. The base plate H1200 is securely bonded to the support plate H1400 having an opening H1401. The support plate H1400 holds the electric wiring board H1300 so as to electrically connect the electric wiring board H1300 with the head substrate H1100. The electric wiring board H1300 serves to apply electric signals for discharging ink to the head substrate H1100, and has electric wires associated with the head substrate H1100 and external signal input terminals H1301 situated at the electric wires' ends for receiving electric signals from the printer body. The external signal input terminals H1301 are positioned and fixed at the back of the tank holder H1500 described later. The configuration of the print head H1001 will be illustrated in further detail later.

The tank holder H1500 that removably holds the ink tanks H1900 is securely bonded to the flow passage forming member H1600 typically by ultrasonic fusing to form an ink passage H1501 from the ink tanks H1900 to the flow passage forming member H1600. At the ink tank side end of the ink passage H1501 that engages with the ink tanks H1900, a filter H1700 is provided to prevent external dust from entering. The seal rubbers H1800 are provided at portions where the filters H1700 engage the ink tanks H1900, to prevent evaporation of the ink from the engagement portion.

As described above, the tank holder H1500, which integrally includes the flow passage forming member H1600, the filters H1700 and the seal rubbers H1800, and the print head H1001, which includes the head substrate H1100, the base plate H1200, the electric wiring board H1300 and the support plate H1400, are combined by the action typically of adhesives to form the head cartridge H1000.

Carriage M4001

As shown in FIG. 1, the carriage M4001 for mounting the head cartridge H1000 has a carriage cover M4002 and a head set lever M4007. The carriage cover M4002 serves to guide the print head H1001 to a predetermined mounting position on the carriage M4001. The head set lever M4007 serves to engage and press against the tank holder H1500 of the head cartridge H1000 so as to set the print head H1001 at a predetermined mounting position.

A contact flexible print cable (contact FPC; not shown) is arranged at another engagement portion of the carriage M4001 with the head cartridge H1000. Contacts on the contact FPC and the contacts (external signal input terminals) H1301 of the head cartridge H1000 are in contact so as to establish an electric connection to thereby receive and transmit print information and to supply power to the head cartridge H1000. The contact FPC is connected to a carriage substrate (not shown) arranged on the back of the carriage M4001.

Print Head H1001

The print head H1001 constituting part of the head cartridge H1000 will be illustrated in further detail with reference to FIGS. 4 to 7, which are an external view of the print head H1001, a sectional view of the bonding site between the head substrate H1100 and the electric wiring board, a sectional view thereof taken along the line VI-VI, and a cutaway view of the head substrate, respectively. Specifically, the base plate H1200 is made of, for example, alumina ($Al_2O_3$) having a thickness of 0.5 to 10 mm. The material for the base plate H1200 can be any material that has a linear expansion coefficient substantially equivalent to, and a thermal conductivity substantially equal to or higher than, that of the head substrate H1100. Examples thereof are silicon (Si), aluminium nitride (AlN), zirconia ($ZrO_2$), silicon nitride ($Si_3N_4$), silicon carbide (SiC), molybdenum (Mo) and tungsten (W).

The base plate H1200 has the individual ink supply passages H1201 for supplying plural inks to the head substrate H1100. The ink supply ports 12 of the head substrate H1100 each correspond to the ink supply passages H1201 of the base plate H1200, and the head substrate H1100 is securely bonded to the base plate H1200 precisely at a specific position.

The support plate H1400 is made of, for example, alumina ($Al_2O_3$) having a thickness of 0.5 to 1 mm. As with the base plate H1200, the material for the support plate H1400 preferably has a linear expansion coefficient substantially equivalent to, and a thermal conductivity substantially equal to or higher than, that of the head substrate H1100. The support plate H1400 has an opening H1401 with an area larger than the external size of the head substrate H1100 which is bonded to the base plate H1200. The support plate H1400 is bonded to the base plate H1200 so as to electrically connect the head substrate H1100 and the electric wiring board H1300 in substantially one plane. The back side of the electric wiring board H1300 is bound to the support plate H1400. The electric wiring board H1300 serves to apply electric signals to the head substrate H1100 for discharging ink, and has an opening H1302 for mounting the head substrate H1100, lead terminals H1303 associated with connection terminals 14 of the head substrate H1100, and external signal input terminals H1301 situated at the ends of lead terminals 1303 for receiving electric signals from the printer body.

The head substrate H1100 comprises a silicon substrate 11 having a thickness of 0.5 to 1 mm and has, for example, a discharge energy generation unit, ink chambers 15 and discharge ports 16 formed by a film forming technique.

The silicon substrate 11 has ink supply ports 12 which penetrate the silicon substrate 11 and are in the form of a long hole. The ink supply port 12 is formed by anisotropic etching utilizing the crystal orientation of the silicon substrate 11. More specifically, when the silicon substrate 11 has a crystal orientation of <100> in its surface and a crystal orientation of <111> in its thickness direction, the ink supply port 12 having a slant at an angle of about 54.7 degrees is formed by anisotropic etching using a basic etchant such as KOH, TMAH or hydrazine. A plurality of electrothermal energy converters 13 are arranged in two lines (for example, 128 in each line) at specific intervals in a staggered manner, on the two sides of the ink supply port 12, and the electrothermal energy converters 13 constitute the discharge energy generation unit.

In addition to the electrothermal energy converters 13 and the connection terminals 14, the silicon substrate 11 further has, for example, electric wires (not shown) for conducting electricity between the electrothermal energy converters 13 and the connection terminals 14. A drive IC (not shown) supplies driving signals and driving power to the electrothermal energy converters 13 via the connection terminals 14. An upper plate member 17 is arranged on the silicon substrate 11. The upper plate member 17 has a plurality of discharge ports 16 facing the electrothermal energy converters 13 with the interposition of the ink chambers 15 by means of which the discharge ports 14 communicate with the ink supply ports 12. Ink passages 18 are arranged between the upper plate member 17 and the silicon substrate 11 for having the ink supply ports 12 communicate with the individual ink chambers 15. The ink passages 18 and the ink supply ports 12 are formed together with the upper plate member 17 by a photolithographic technique, as are the discharge ports 16. The upper plate member 17 has dams 21 in the form of grooves on the side of the connection terminals 14. The dams 21 extend in a direction of the arrangement of the connection terminals 14. Where a sealant 20 (described later) is applied to a bonding site between the connection terminals 14 and the lead terminals H1303, the sealant flows into the dams 21. Thus, the dams 21 prevent the sealant 20 from flowing out to the discharge ports 16.

A driving signal is applied to an electrothermal energy converter 13 in a corresponding ink chamber 15, and the electrothermal energy converter 13 generates heat to thereby bring the liquid supplied from the ink supply port 12 to the individual ink chamber 15 to a boil. The liquid is then discharged from the discharge port 16 by the action of the pressure of the resulting bubbles. The bubbles formed in the ink chamber 15 grow and come to communicate with the external atmosphere via the discharge port 16, thus constituting an "air-communication state".

The support plate H1400 has a square opening H1401 surrounding the head substrate H1100. Sealant receivers 19 are integrally formed in the opening H1401 in the proximity of the connection terminals 14 of the head substrate H1100. The thickness t1 of the support plate H1400 is set to be larger than the height h2 from the surface of the base plate H1200 to the upper ends of the connection terminals 14 of the head substrate H1100 so as to avoid the contact of the lead terminal H1303 of the electric wiring board H1300 with the edge of the head substrate H1100. The height h1 from the surface of the base plate H1200 to the upper surface of the sealant receivers 19 is set to be equal to or less than the thickness t2 of the silicon substrate 11 so as to avoid deterioration of the electrical connection between the connection terminals 14 and the lead terminals H1303.

Sealing Process

Figure 5:
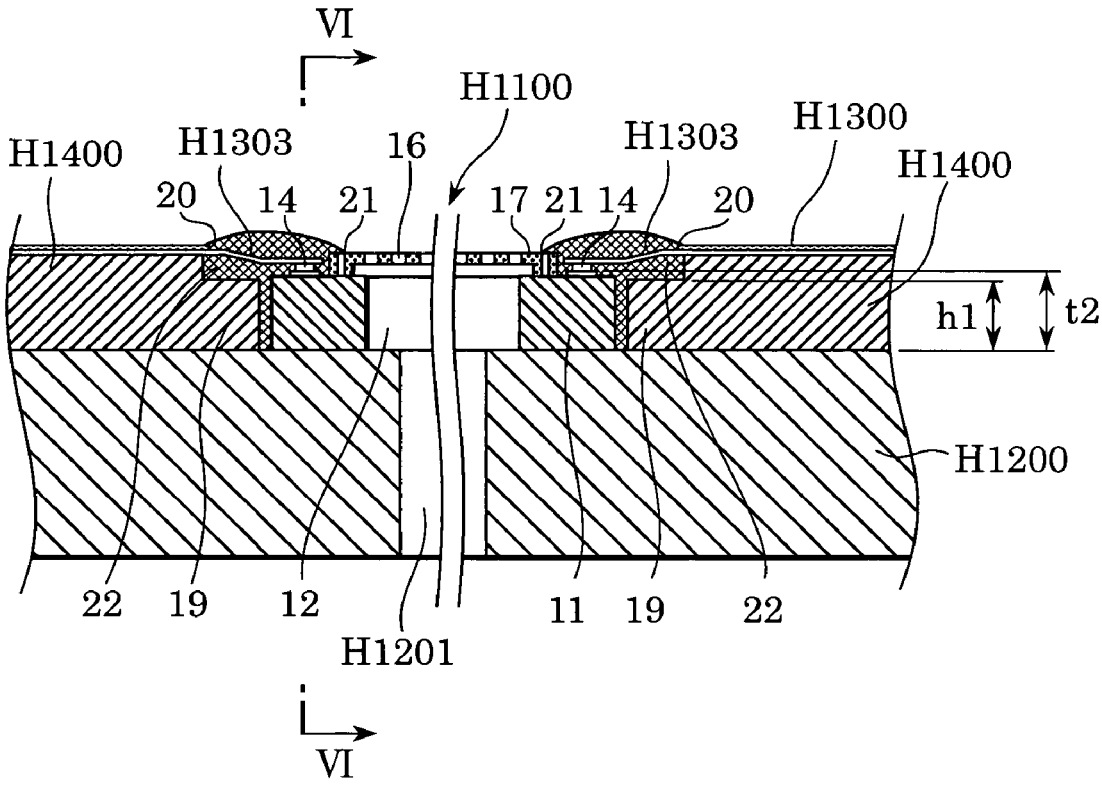
FIG. 5 is a schematic sectional view of the ink jet head of FIG. 4.
Figure 6:
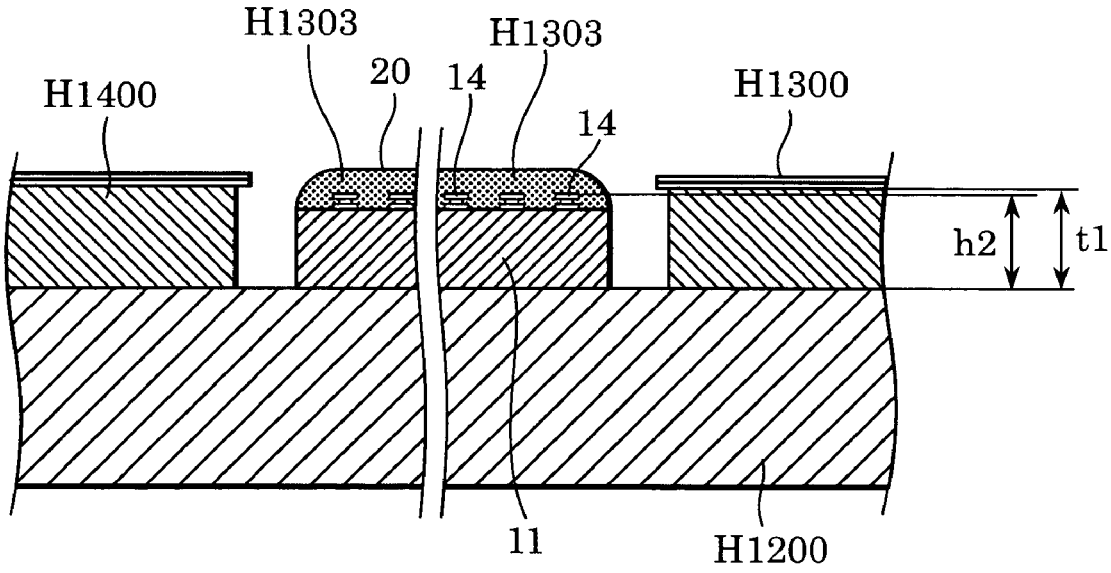
FIG. 6 is a sectional view taken along the line VI-VI in FIG. 5.
Figure 7:
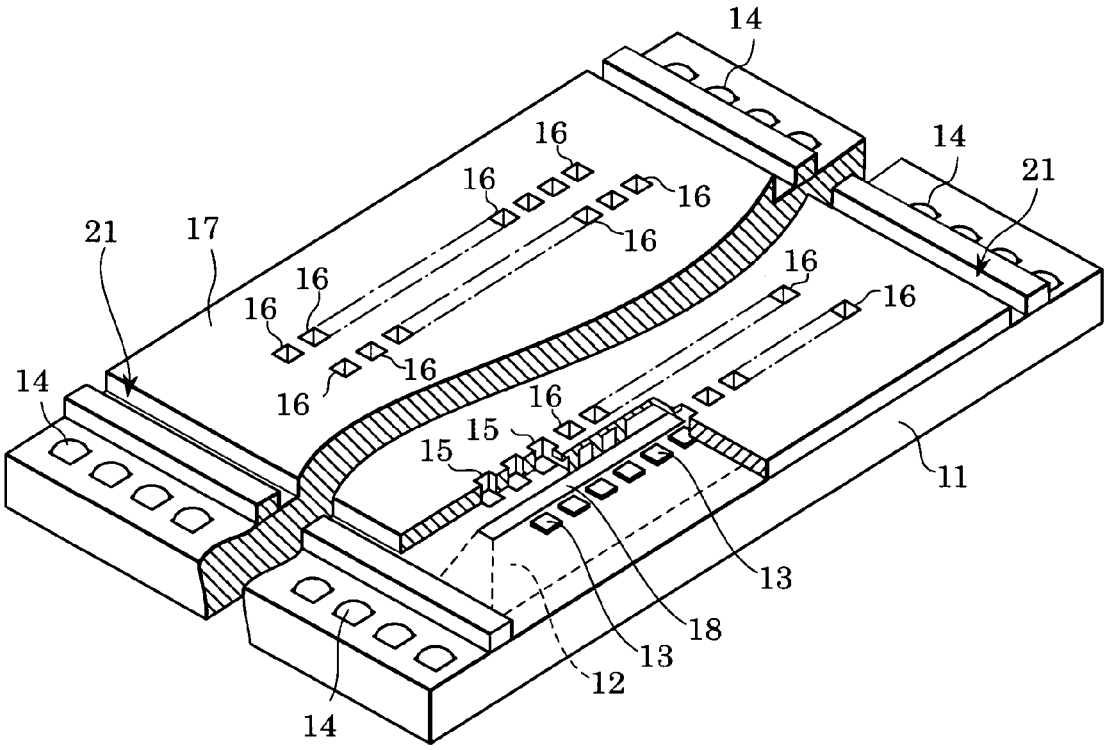
FIG. 7 is a perspective cutaway view of the external appearance of a head substrate.

Next, the site of bonding between the connection terminals 14 of the head substrate H1100 and the lead terminals H1303 of the electric wiring board H1300 is sealed with sealants in the following manner. Initially, a chip-periphery sealant 22 is applied and is allowed to flow around the backsides of the lead terminals H1303 by the action of capillary attraction to thereby enter between the lead terminals H1303 and the sealant receivers 19 and between the sealant receivers 19 and the head substrate H1100. Then an ILB sealant 20 is applied onto the lead terminals H1303 so as to protect the lead terminals H1303. In this procedure, the ILB sealant 20 is laminated on the chip-periphery sealant 22 so as to avoid the formation of a gap. The ILB sealant 20 is applied so that at least the space under the lead terminals H1303 is filled with the chip-periphery sealant 22 without a gap at portions where the lead terminals H1303 exist. Above the lead terminals H1303, the ILB sealant is applied so as to cover the lead terminals 1303 and the chip-periphery sealant 22 without a gap (FIG. 5).

After applying the chip-periphery sealant and the ILB sealant, the two sealants are cured simultaneously. The curing is carried out, for example, by heating at 150° C. for 4 hours.

The above-mentioned ink jet head was prepared according to the method mentioned above using the sealing materials according to the present invention and its properties were determined.

Specifically, sample chip-periphery sealant 22 and ILB sealant 20 were applied to an ink jet head part and their properties were determined. The ink jet head part had been subjected to a process for connecting a flexible wiring board to the electrical contact of the head substrate. Thus, the ink jet head part comprised a supporting plate such as an alumina plate bearing the head substrate having the electrical contact connected to the flexible wiring board. In the curing of the sealants, materials containing volatile components in large quantities were subjected to step curing so as to cure the resins without foaming of the volatile components.

The base resins, curing agents, contents of fillers, hardness after curing, thixotropic factors and curing conditions of the materials used in the examples and comparative examples are shown in Table 1.

Sealant A comprises an ILB sealant and a chip-periphery sealant containing the same base resin and the same curing agent.

Sealant B comprises an ILB sealant and a chip-periphery sealant comprising the same base resin and the same curing agent as Sealant A, but comprises a filler in a content larger than that in Sealant A. Thus, Sealant B has a higher hardness and thixotropic factor than Sealant A.

Sealants A and B were cured under the same conditions by step curing in which the sealant is heated at 100° C. for 1 hour and then heated at 150° C. for 4 hours.

Sealant C comprises conventional materials for sealants and is used as a comparative example. As is shown in Table 1, Sealant C comprises an ILB sealant and a chip-periphery sealant containing different base resins and different curing agents. After applying the chip-periphery sealant and the ILB sealant, the two sealants were simultaneously heated at 150° C. for 4 hours.

Sealant D has the same configuration as Sealant C, except for heating conditions. More specifically, in Sealant D, a chip-periphery sealant is applied and cured at 150° C. for 4 hours, and then an ILB sealant is applied onto the cured chip-periphery sealant and is then cured at 150° C. for 4 hours.

Sealant E has the same configuration as Sealant A, except for using an ILB sealant containing no filler, and a chip-periphery sealant containing 50% of a filler. Sealant E was cured under the same conditions as Sealants A and B by step curing in which the sealant is heated at 100° C. for 1 hour and then heated at 150° C. for 4 hours.

TABLE 1

| | | Material Properties | | | | | |
|---|---|---|---|---|---|---|---|
| | Sealant | Base Resin | Curing Agent | Filler | Hardness | Thixotropy Factor | Curing Condition |
| A | ILB Sealant | Silicone-, Polybutadiene-modified Epoxy Resin | Amine | 50 | 65 | 1.7 | Step curing (*) |
| | Chip-periphery Sealant | Silicone-, Polybutadiene-modified Epoxy Resin | Amine | 0 | 31 | 1.0 | |
| B | ILB Sealant | Silicone-, Polybutadiene-modified Epoxy Resin | Amine | 70 | 85 | 2.2 | Step curing (*) |
| | Chip-periphery Sealant | Silicone-, Polybutadiene-modified Epoxy Resin | Amine | 0 | 31 | 1.0 | |
| C | ILB Sealant | Bisphenol-A Epoxy Resin | Acid Anhydride | 73 | 99 | 3.0 | Simultaneous Curing, 150° C., 4 hr |
| | Chip- | Silicone-, Polybutadiene- | Amine | 0 | 31 | 1.0 | |

TABLE 1-continued

| | Material Properties | | | | | | |
|---|---|---|---|---|---|---|---|
| | Sealant | Base Resin | Curing Agent | Filler | Hardness | Thixotropy Factor | Curing Condition |
| | periphery Sealant | modified Epoxy Resin | | | | | |
| D | ILB Sealant | Bisphenol-A Epoxy Resin | Acid Anhydride | 73 | 99 | 3.0 | Separate Curing |
| | Chip-periphery Sealant | Silicone-, Polybutadiene-modified Epoxy Resin | Amine | 0 | 31 | 1.0 | |
| E | ILB Sealant | Silicone-, Polybutadiene-modified Epoxy Resin | Amine | 0 | 31 | 1.0 | Step curing (*) |
| | Chip-periphery Sealant | Silicone-, Polybutadiene-modified Epoxy Resin | Amine | 50 | 65 | 1.7 | |

Step curing (*): heating at 100° C. for 1 hr, and then at 150° C. for 4 hr.

The properties of the ink jet heads produced using Sealants A, B, C, D and E were determined as Examples 1 and 2, and Comparative Examples 1, 2 and 3, respectively. The results are shown in Table 2.

Surface Appearance

The boundary between the ILB sealant and the chip-periphery sealant was observed under a scanning electron microscope, and the surface appearance was evaluated according to the following criteria.

Good: No cavity is observed at a portion sealed by the ILB sealant on the side of the chip.

Failure: The chip-periphery sealant extends off the side of the chip, and a cavity is observed at the boundary with the ILB sealant.

Sectional Profile

Each of the above-prepared ink jet heads was cut using a dicing saw and polished, and the cross section was observed under an optical microscope.

Good: No cavity is observed at the boundary between the periphery of the chip and the ILB sealant or inside the sealants.

Failure: A cavity is observed at the boundary between the periphery of the chip and the ILB sealant or inside the sealants.

Tact

Tact is defined as the amount of time required for the chip-periphery sealant and the ILB sealant to be applied and cured.

Good: It takes about half the time required by the conventional technique, in which the sealants are cured separately.

Failure: It takes substantially the same amount of time as is required by the conventional technique, in which the sealants are cured separately.

Curing Inhibition

Good: The boundary between the ILB sealant and the chip-periphery sealant is dry.

Failure: The boundary between the ILB sealant and the chip-periphery sealant is tacky.

Paper Jamming Test

Each of the above-prepared ink jet heads was mounted to an ink jet printer BJF 890 (product of Canon Kabushiki Kaisha). A solid pattern was printed on one sheet of plain paper (product of Canon Kabushiki Kaisha; A4-sized). In this procedure, paper jamming was forcedly brought by blocking the paper-eject side of the printer. The paper partially ejected from the ejection roller was forcedly taken out while swinging the paper by hand.

Good: No chipping, fracture or tearing of the ILB sealant occurs even after repeating the manual sheet ejection procedure ten times.

Failure: Chipping, fracture and/or tearing of the ILB sealant occurs upon repeating the manual sheet ejection procedure ten times.

Thermal Stability

Each of the above-prepared ink jet heads was subjected to 100 repetitive cycles of a thermal cycle in which the temperature was varied between 0° C. and 60° C.

Good: No particular change is observed.

Failure: The chip is broken.

In this connection, when the chip-periphery sealant has a high hardness, it does not serve as a cushioning member with respect to volume change due to thermal expansion of the organic sealant, which has a larger thermal expansion coefficient than the inorganic chip and support plate. Thus, the chip is broken.

TABLE 2

| | Results | | | | | | |
|---|---|---|---|---|---|---|---|
| | Sealant | Surface Appearance | Sectional Profile | Tact | Curing Inhibition | Paper Jamming Test | Thermal Stability |
| Example 1 | A | Good | Good | Good | Good | Good | Good |
| Example 2 | B | Good | Good | Good | Good | Good | Good |
| Comp. Ex. 1 | C | Failure | Failure | Good | Failure | Failure | Good |
| Comp. Ex. 2 | D | Good | Failure | Failure | Good | Good | Good |

TABLE 2-continued

| | Results | | | | | | |
|---|---|---|---|---|---|---|---|
| | Sealant | Surface Appearance | Sectional Profile | Tact | Curing Inhibition | Paper Jamming Test | Thermal Stability |
| Comp. Ex. 3 | E | Good | Good | Good | Good | Failure | Failure |

Examples 1 and 2 both performed satisfactorily.

In contrast, in Comparative Example 1 using the sealants containing different base resins, cavity formation at the boundary between the two sealants, bubbling in the cross section and curing inhibition are observed. These phenomena typically occur because of differences in the degree of shrinkage upon curing between the chip-periphery sealant and the ILB sealant. Delamination of the sealant is observed in the paper jamming test, although the ILB sealant is harder than the chip-periphery sealant.

Comparative Example 2 is most similar to conventional sealants in materials and curing conditions. Thus, it satisfies practical requirements, but takes a long time for the head to be manufactured, since the ILB sealant is applied and cured after the chip-periphery sealant is cured. In addition, bubbles are observed in the cross section.

Comparative Example 3 uses identical base materials and identical curing agents in the chip-periphery sealant and ILB sealant, as in Examples 1 and 2. However, the chip-periphery sealant herein is harder than the ILB sealant. Thus, breakage of the chip, and tearing and chipping of the ILB sealant in the paper jamming test occur.

These results show that, when an ink jet head is produced by using an ILB sealant and a chip-periphery sealant, in which the former is harder than, and contains the same base resin and the same curing agent as, the latter, the resulting ink jet head is free from problems such as electrical failures, cavities and fissure formation caused by a difference in linear expansion coefficients (poor low-temperature properties), even when the two sealants are cured simultaneously. This is because the two sealants are cured at an identical rate, the curing agents do not mix and curing inhibition does not occur.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A method for manufacturing an ink jet head comprising a head substrate having discharge elements for discharging ink, and an electric wiring board electrically connected to the head substrate, the method comprising the steps of:

applying a first sealant to a periphery of the head substrate, the first sealant comprising a base resin and a curing agent, and not comprising a filler, and the periphery constituting a boundary between the head substrate and a member supporting the head substrate;

providing a second sealant comprising the same base resin and the same curing agent as in the first sealant, the second sealant having a curing rate substantially the same as a curing rate of the first sealant;

applying the second sealant to an electric splice between the head substrate and the electric wiring board so as to cover the applied first sealant; and starting heating and curing of the first and second sealants simultaneously.

2. A method for manufacturing an ink jet head according to claim 1, wherein the base resin in the first sealant and the base resin in the second sealant comprise an epoxy resin and the curing agent in the first sealant and the curing agent in the second sealant comprise an amine.

3. A method for manufacturing an ink jet head according to claim 1, wherein the second sealant has a filler.

4. A method for manufacturing an ink jet head according to claim 1, wherein the epoxy resin has an epoxy equivalent of 1000 or more.

* * * * *